US010239331B1

(12) United States Patent
Gervais et al.

(10) Patent No.: US 10,239,331 B1
(45) Date of Patent: Mar. 26, 2019

(54) CHOKES FOR MICROWAVE DRYERS THAT BLOCK MICROWAVE ENERGY AND ENHANCE THERMAL RADIATION

(71) Applicants: Bryan Giroux Gervais, Loveland, CO (US); Andrew David Norte, Westminster, CO (US)

(72) Inventors: Bryan Giroux Gervais, Loveland, CO (US); Andrew David Norte, Westminster, CO (US)

(73) Assignee: Ricoh Company, Ltd., Boulder, CO (US)

( * ) Notice: Subject to any disclaimer, the term of this patent is extended or adjusted under 35 U.S.C. 154(b) by 0 days.

(21) Appl. No.: 15/715,727

(22) Filed: Sep. 26, 2017

(51) Int. Cl.

| | |
|---|---|
| ***B41J 11/00*** | (2006.01) |
| ***F26B 3/30*** | (2006.01) |
| ***F26B 15/14*** | (2006.01) |
| ***F26B 3/347*** | (2006.01) |

(52) U.S. Cl.
CPC ..... *B41J 11/002* (2013.01); *F26B 3/30* (2013.01); *F26B 3/347* (2013.01); *F26B 15/14* (2013.01)

(58) Field of Classification Search
CPC ..... B41J 11/002; F26B 3/30
See application file for complete search history.

(56) References Cited

U.S. PATENT DOCUMENTS 3,519,517 A 7/1970 Dench
3,749,874 A 7/1973 Edgar
4,176,267 A 11/1979 Rueggeberg
4,405,850 A 9/1983 Edgar
4,488,027 A * 12/1984 Dudley ..... H05B 6/782 219/699
5,422,463 A 6/1995 Gooray et al.
5,757,407 A * 5/1998 Rezanka ..... B41J 11/002 347/102
5,998,774 A 12/1999 Joines et al.
6,375,918 B1 4/2002 Ota et al.
6,768,089 B2 7/2004 Minobe et al.
6,888,115 B2 5/2005 Drozd
7,087,874 B2 8/2006 Ishikawa et al.
(Continued)

OTHER PUBLICATIONS

Carbopack Adsorbent mesh bottle; Sigma-Aldrich; www.sigmaaldrich.com.

(Continued)

*Primary Examiner* — Jason S Uhlenhake
(74) *Attorney, Agent, or Firm* — Duft & Bornsen, PC

(57) ABSTRACT

Systems and methods are provided for chokes for microwave radiation. One embodiment is an apparatus that includes a choke assembly. The assembly includes a first choke plate, and a second choke plate. The assembly also includes a first layer disposed at a surface of the first choke plate. The first layer includes a material that attenuates microwave radiation via dielectric heating by converting the microwave radiation into heat, and a substance, disposed between the material of the first layer and the gap, that is transparent to the microwave radiation. The assembly further includes a second layer disposed at a surface of the second choke plate that faces the first layer. The second layer comprises the material that attenuates the microwave radiation via dielectric heating by converting the microwave radiation into heat, and the substance, disposed between the material of the second layer and the gap.

20 Claims, 7 Drawing Sheets

(56) References Cited

U.S. PATENT DOCUMENTS

| | | | | |
|---|---|---|---|---|
| 7,368,692 | B1 | 5/2008 | Hallac | |
| 7,470,876 | B2 | 12/2008 | Drozd et al. | |
| 9,358,809 | B2 | 6/2016 | Biegelsen | |
| 9,504,098 | B2 | 11/2016 | Peelamedu | |
| 2007/0079719 | A1 | 4/2007 | Rohde et al. | |
| 2015/0237684 | A1 | 8/2015 | Huber | |
| 2017/0158892 | A1* | 6/2017 | Takahashi | B41J 2/175 |

OTHER PUBLICATIONS

Frederick W. Ahrens; Application of a Device for Uniform Web Drying and Preheating Using Microwave Energy; Final Report; Sep. 2003.

U.S. Appl. No. 15/435,978.

J. E. Atwater, R. R. Wheeler, Jr., "Temperature dependent complex permittivities of graphitized carbon blacks at microwave frequencies between 0.2 and 26 GHz," Journal of Materials Science 39 (2004), 151-157.

* cited by examiner

CHOKES FOR MICROWAVE DRYERS THAT BLOCK MICROWAVE ENERGY AND ENHANCE THERMAL RADIATION

FIELD OF THE INVENTION

The invention relates to the field of dryers, and in particular, to continuous-process microwave dryers.

BACKGROUND

Production printing systems for high-volume printing typically utilize a production printer that marks a continuous-forms print medium (e.g., paper) with a wet colorant (e.g., an aqueous ink). After marking the continuous-forms print medium, a dryer downstream from the production printer is used to dry the colorant applied to the continuous-forms print medium. Microwave dryers may be employed as a dryer for a production printing system in some applications.

A microwave dryer utilizes microwave energy to heat the colorant to cause a liquid portion of the colorant to evaporate, thereby fixing the colorant to the continuous-forms print medium. A microwave source directs the microwave energy down a long axis of a waveguide, and a passageway through the waveguide is sized to enable the continuous-forms print medium to pass through the waveguide. As the continuous-forms print medium traverses the passageway, wet colorant applied to the continuous-forms print medium is exposed to the microwave energy and is heated.

To achieve a sufficient level of drying, microwave dryers generate a substantial amount of microwave radiation. This microwave radiation must be blocked before it exits the microwave dryer in order to ensure that the microwave radiation is contained within the desired dryer operating areas and that components external to the dryer are not heated by microwaves. At the same time, it remains important to reduce the path length occupied by drying systems in order to save space within a print shop.

SUMMARY

Embodiments described herein provide for chokes that attenuate microwave radiation emitted from microwave dryers that dry continuous-forms print media and/or other planar substrates. The chokes have been enhanced to convert microwave radiation into heat, thereby ensuring that drying continues as the continuous-forms media proceeds through the chokes. Furthermore, the chokes may utilize a substance that is transparent to microwave radiation in order to structurally support (e.g., encase) a material that performs the conversion of microwave radiation into heat.

One embodiment is an apparatus that includes a choke assembly. The assembly includes a first choke plate, and a second choke plate that is positioned a distance away from the first choke plate, resulting in a gap between the first choke plate and the second choke plate. The assembly also includes a first layer disposed at a surface of the first choke plate. The first layer includes a material that attenuates microwave radiation via dielectric heating by converting the microwave radiation into heat, and a substance, disposed between the material of the first layer and the gap, that is transparent to the microwave radiation. The assembly further includes a second layer disposed at a surface of the second choke plate that faces the first layer. The second layer comprises the material that attenuates the microwave radiation via dielectric heating by converting the microwave radiation into heat, and the substance, disposed between the material of the second layer and the gap, that is transparent to the microwave radiation.

A further embodiment is a system that includes a microwave dryer that applies microwave radiation to a planar substrate traveling through a waveguide of the microwave dryer in a process direction, and a choke assembly downstream of the microwave dryer. The choke assembly includes a first choke plate, and a second choke plate that is positioned a distance away from the first choke plate, resulting in a gap between the first choke plate and the second choke plate for receiving a planar substrate. The assembly also includes a first layer disposed at a surface of the upper choke plate. The first layer includes a material that attenuates microwave radiation via dielectric heating by converting the microwave radiation into heat; and a substance, disposed between the material of the first layer and the gap, that is transparent to the microwave radiation. The first layer also includes a second layer disposed at a surface of the second choke plate that faces the first layer. The second layer includes the material that attenuates the microwave radiation via dielectric heating by converting the microwave radiation into heat; and the substance, disposed between the material of the second layer and the gap, that is transparent to the microwave radiation.

A further embodiment is a method. The method includes drying a planar substrate via microwave radiation while a planar substrate travels in a process direction through a waveguide of a microwave dryer, transporting the planar substrate through a choke assembly disposed downstream of the microwave dryer, and receiving microwave radiation at the choke assembly from an opening of the microwave dryer via which the planar substrate exits the microwave dryer. The method also includes permitting the microwave radiation to transparently pass through a solid component of the choke assembly, and performing dielectric heating by converting received microwave radiation into heat, wherein the dielectric heating is performed by a material disposed along an interior of the choke assembly.

Other illustrative embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific illustrative embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
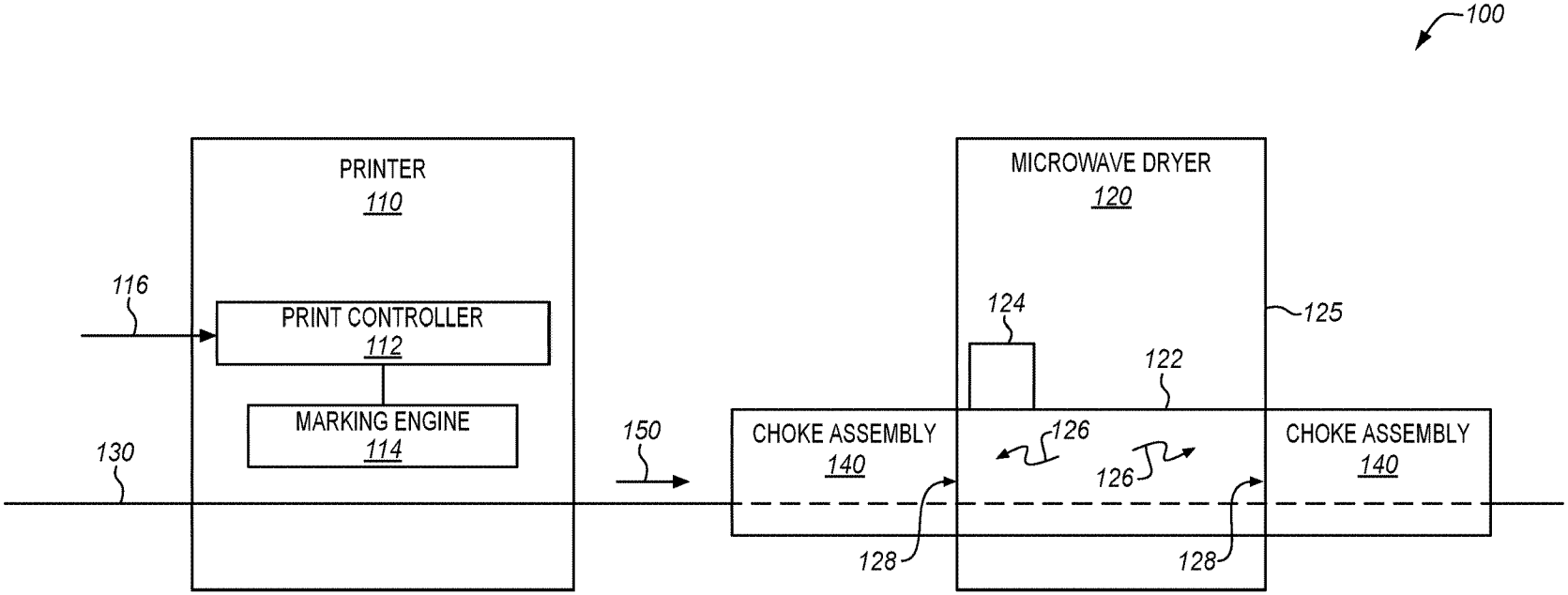
FIG. 1 is a block diagram of a printing system in an illustrative embodiment.

FIG. 1 is a block diagram of a printing system 100 in an exemplary embodiment. Printing system 100 comprises any system capable of marking print media (or other objects) and performing microwave drying as part of a continuous process. In this embodiment, printing system 100 includes printer 110, microwave dryer 120, and planar substrate 130 (e.g., a continuous-forms print medium, a continuous transport belt bearing cut-sheet print media, etc.). Planar substrate 130 travels along process direction 150 in FIG. 1 to receive marking at printer 110 and drying at microwave dryer 120.

Print controller 112 of printer 110 receives print data 116 which defines locations at which to mark underlying print media. Print data 116 may be defined according to a Page Description Language (PDL), such as Portable Document Format (PDF). Print data 116 is rasterized by print controller 112 into bitmap data. The bitmap data is used by marking engine 114 (e.g., a drop-on-demand print engine) of printer 110 to apply wet colorant as planar substrate 130 travels downstream towards microwave dryer 120. In embodiments where planar substrate 130 is a continuous-forms print medium, planar substrate 130 is marked by marking engine 114 of printer 110. In embodiments where planar substrate 130 comprises a continuous transport belt, items being carried by planar substrate 130 (e.g., cut-sheet print media) are marked by marking engine 114 of printer 110. Some examples of print media include paper and textiles. Marking engine 114 may apply a wet or liquid colorant, such as one or more aqueous inks. Thus, printer 110 may comprise a continuous-forms inkjet printer, a cut-sheet inkjet printer, etc. Print controller 112 may be implemented as custom circuitry, as a hardware processor executing programmed instructions, etc.

Wet colorant applied by marking engine 114 is dried by microwave dryer 120. Specifically, microwave dryer 120 applies microwave radiation 126 (e.g., microwave energy) from source 124 along waveguide 122, which is disposed within housing 125 (e.g., a steel housing). Microwave radiation 126 heats wet colorant by electromagnetic heating (i.e., dielectric heating) to evaporate a liquid portion of the wet colorants. This fixes wet colorant to the medium that was marked.

In order to ensure that microwave radiation is attenuated prior to exiting microwave dryer 120, choke assemblies 140 are disposed at one or more openings 128 of microwave dryer 120. Choke assemblies 140 attenuate microwave radiation 126 such that microwave radiation exiting choke assemblies 140 is below a threshold level. For example, choke assemblies 140 may attenuate microwave radiation in accordance with, e.g., 29 Code of Federal Regulations § 1910.97 to ensure less than ten milliwatts per square centimeter of exposure. Choke assemblies 140 increase in temperature in response to attenuating the microwave radiation, which ensures that heated drying continues while planar substrate 130 travels through choke assemblies 140.

Figure 2:
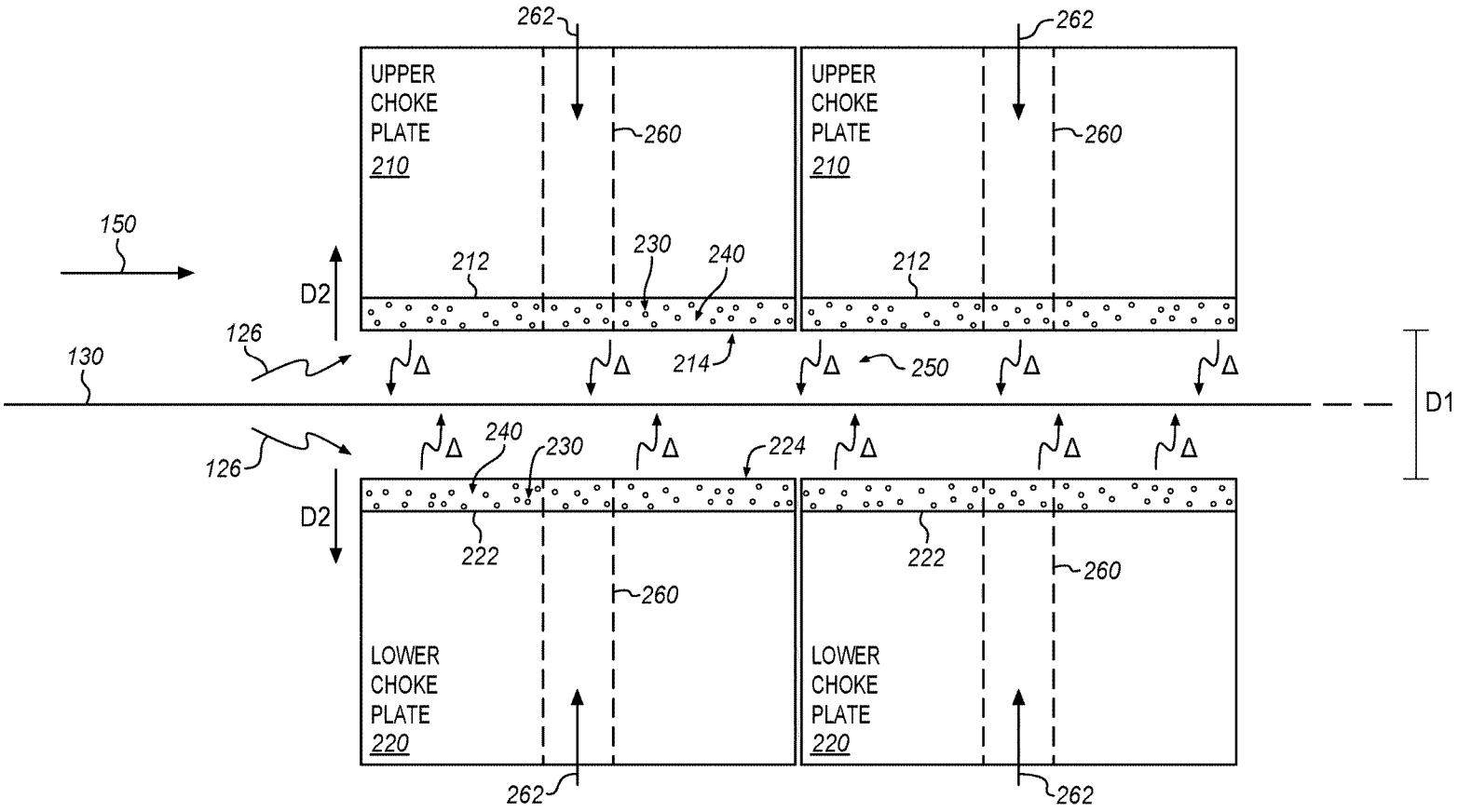
FIG. 2 is a side view of a choke assembly for a microwave dryer in an illustrative embodiment.

FIG. 2 is a side view of choke assembly 140 in an illustrative embodiment. In this embodiment, choke assembly 140 is located downstream of microwave dryer 120, and proceeds to attenuate microwave radiation 126. Choke assembly 140 comprises upper choke plates 210, and lower choke plates 220. Lower choke plates 220 are positioned a distance D1 (e.g., one centimeter) below upper choke plates 210. This forms gap 250 through which planar substrate 130 travels (i.e. passes through unimpeded). Vent holes 260 are also illustrated, which penetrate through upper choke plates 210 and lower choke plates 220 to enable convective heat transfer with the air.

Upper choke plates 210 include lower layer 212, which directly receives microwave radiation 126 from microwave dryer 120. That is, microwave radiation 126 directly strikes lower layer 212, because lower layer 212 is disposed at lower surface 214 of upper choke plate 210. Lower layer 212 comprises material 230, which attenuates microwave radiation 126 by engaging in dielectric heating by converting microwave radiation 126 into heat (A). For example, material 230 may comprise particles of graphitized carbon black that have a particle size between 50 micrometers (μm) and 500 μm (e.g., 180 μm-250 μm), or may comprise another suitable susceptor material that performs dielectric heating in response to microwave radiation.

As distance (D2) from lower surface 214 increases, a concentration of material 230 within lower layer 212 (e.g., volume of material 230 per unit volume of lower layer 212) may decrease. For example, material 230 may ramp down in concentration linearly within lower layer 212 as D2 increases, from a first concentration (e.g., fifty percent) to a second concentration (e.g., ten percent).

Material 230 is structurally supported and protected by substance 240. For example, a matrix of substance 240 may surround particles of material 230. Hence, at least some amount of substance 240 is disposed between material 230 and gap 250. Substance 240 is transparent to microwave radiation. As used herein, substances are transparent to microwave radiation if they exhibit a low index of refraction or low dielectric permittivity (e.g., between 2 and 4, such as 3) for microwave radiation between 2 and 3 GHz (e.g., 2.45 GHz). Substances may also be considered transparent to microwave radiation if they allow more than fifty percent (e.g., seventy five percent) transmission through microwave radiation between 2 and 3 GHz (e.g., 2.45 GHz). Substance 240 may comprise fused quartz, fused silica, another type of glass, etc. Substance 240 may also be chosen for exhibiting a melting point that is above a threshold amount, such as a melting point higher than one thousand degrees Celsius (° C.), such as >1600° C. Particles of material 230 may be "doped" into substance 240, and may comprise a sub-layer of loose particles that are mechanically supported by substance 240, etc.

As air travels through vent holes 260 (e.g., in the direction indicated by arrows 262), the air is convectively heated by substance 240, which is itself heated by material 230. This ensures that the air is heated when it strikes planar substrate 130, facilitating the drying process.

Lower choke plates 220 include upper layer 222, which directly receives microwave radiation 126 from microwave dryer 120. That is, microwave radiation 126 directly strikes upper layer 222, because upper layer 222 is disposed at upper surface 224 of lower choke plate 220. Upper layer 222 comprises material 230 as well as substance 240 in a similar manner to lower layer 212. As distance (D2) from upper surface 224 increases, a concentration of material 230 within upper layer 222 may decrease. For example, material 230 may ramp down in concentration linearly within upper layer 222 as D2 increases, from a first concentration (e.g., fifty percent) to a second concentration (e.g., ten percent).

Figure 3:
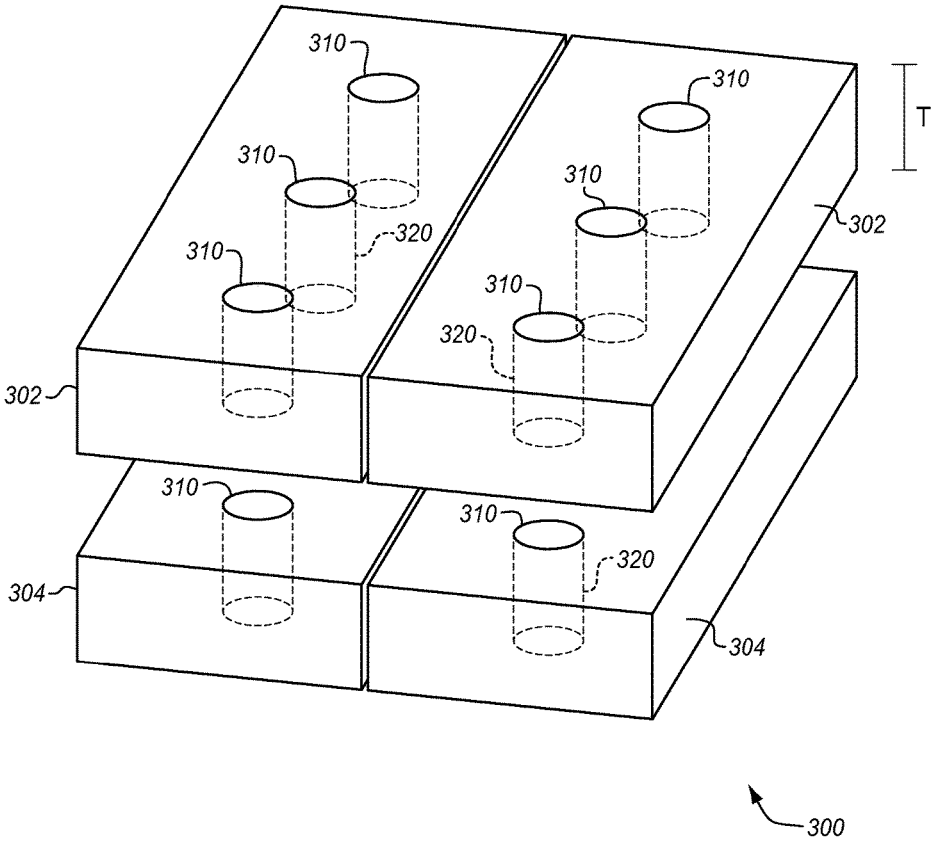
FIG. 3 is a perspective view of vent holes at a choke assembly for a microwave dryer in an illustrative embodiment.

FIG. 3 further illustrates additional features of an illustrative choke assembly. Specifically, FIG. 3 is a perspective view of vent holes 310 at choke assembly 300. In this embodiment, vent holes 310 are placed into upper choke plates 302, as well as lower choke plates 304. Vent holes 310 proceed along the entire thickness (T) of the choke plates (e.g., including any layers in which material 230 and substance 240 of FIG. 2 may be disposed), resulting in passages 320 via which air may flow through the choke plates. This facilitates convective cooling of the choke plates during operation, which ensures that substance 240 and material 230 do not melt or otherwise overheat. At the same time, this heated air continues onward to strike planar substrate 130, drying planar substrate 130.

The particular arrangements, numbers, and configurations of components described herein are illustrative and non-limiting. Illustrative details of the operation of choke assemblies will be discussed with regard to FIG. 4. Assume, for this embodiment, that planar substrate 130 has traveled through printer 110 and that marking has been performed by marking engine 114 (either directly onto planar substrate 130, or onto print media carried atop planar substrate 130). Further, assume that planar substrate 130 is traveling downstream towards microwave dryer 120.

Figure 4:
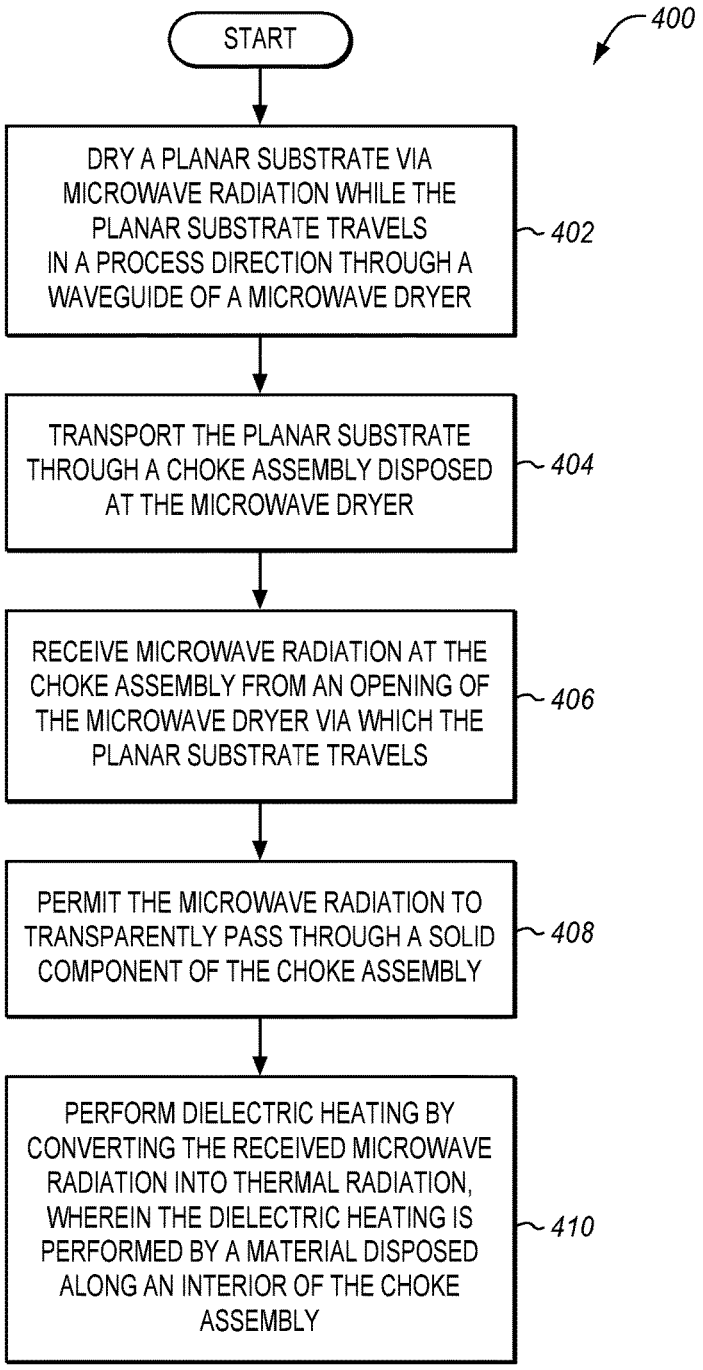
FIG. 4 is a flowchart illustrating a method for utilizing a choke assembly for a microwave dryer in an illustrative embodiment.

FIG. 4 is a flowchart illustrating a method 400 for utilizing a choke assembly for a microwave dryer in an illustrative embodiment. The steps of method 400 are described with reference to printing system 100 of FIG. 1, but those skilled in the art will appreciate that method 400 may be performed in other systems. The steps of the flowcharts described herein are not all inclusive and may include other steps not shown. The steps described herein may also be performed in an alternative order.

Planar substrate 130 enters microwave dryer 120 for drying. Thus, microwave dryer 120 dries planar substrate 130 while planar substrate 130 travels in process direction 150 through waveguide/cavity 122 (step 402). Planar substrate 130 (e.g., printed media) is transported through gap 250 of choke assembly 140, which is disposed at microwave dryer 120 (e.g., upstream of dryer 120 and abutting an entrance to dryer 120, or downstream of dryer 120 and abutting an exit of dryer 120) (step 404). Planar substrate 130 may be driven, for example, by one or more drive rollers (not shown) that direct planar substrate 130 forward at a constant but adjustable rate of travel through microwave dryer 120.

While planar substrate 130 travels through choke assembly 140, material 230, which is disposed along an interior of choke assembly 140, receives microwave radiation 126 (step 406). The microwave radiation is received from an opening of microwave dryer 120 via which planar substrate 130 travels (e.g., an entrance or exit of microwave dryer 120). Substance 240 (which is a solid component of choke assembly 140) permits the microwave radiation to transparently pass through it in order to reach material 230 (step 408). In response to receiving microwave radiation 126, material 230 performs dielectric heating that converts the received microwave radiation into heat (step 410). Material 230 transfers heat to substance 240 (e.g., via conduction). In one embodiment, material 230 emits thermal radiation, and an amount of thermal radiation from material 230 may strike planar substrate 130, ensuring that planar substrate 130 continues to be heated as it travels through choke assembly 140. In addition, forced air passing through cylindrical vents 310 facilitates drying of planar substrate 130 by reducing the size of a boundary layer between a surface of substrate 130 and the impinging air. In further embodiments, apertures may be placed on sides of choke assembly to facilitate the extraction of the vaporized volatiles from choke assembly 140.

Planar substrate 130 may then exit choke assembly 140, while a new portion of planar substrate 130 enters microwave dryer 120. In this manner, steps 402-408 may be performed concurrently with each other as part of a continuous printing and/or drying process. Thus, materials which normally would be incapable of supporting themselves (e.g. powdered materials) may be used in a manner that allows for both attenuation of microwave radiation and generation of heat.

Figure 5:
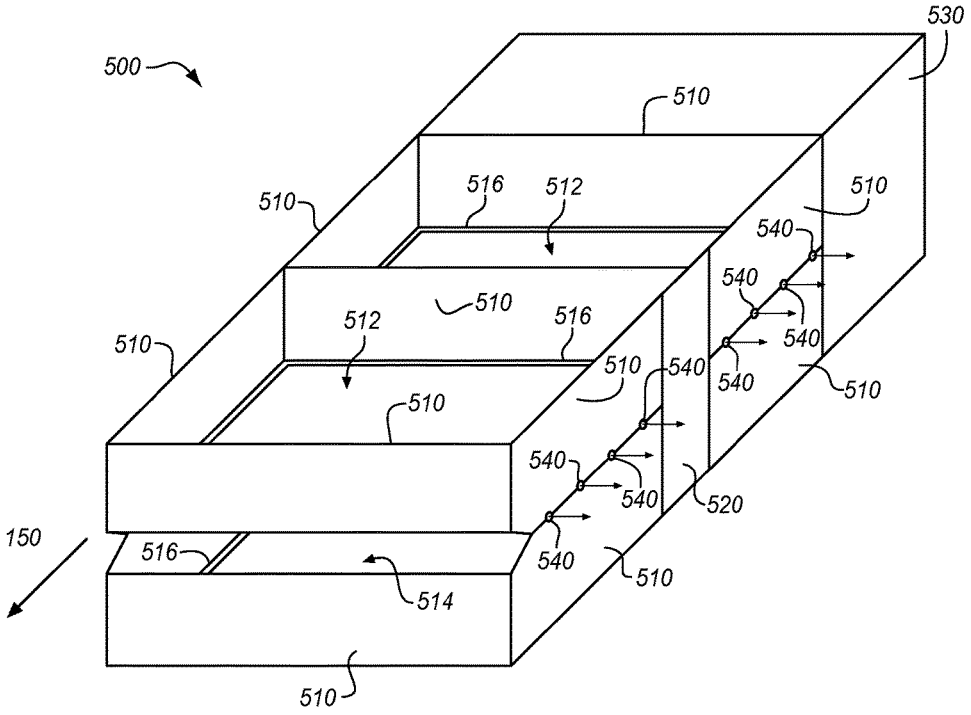
FIG. 5 is a perspective view of a frame for a choke assembly in an illustrative embodiment.

FIG. 5 is a perspective view of a frame 500 for a choke assembly in an illustrative embodiment. Frame 500 may be constructed, for example, from sheet metal or another structurally rigid material. In this embodiment, frame 500 includes a first set of horizontal frame elements 510, which define upper compartments 512 in which upper choke plates 210 (e.g., including rods filled with material 230) are disposed. A second set of horizontal frame elements 510 define lower compartments 514 in which lower choke plates 220 (e.g., including rods filled with material 230) are disposed. Lips 516 are placed at lower edges of the compartments to ensure that choke plates do not fall through their respective compartments.

Vertical frame elements 520 unite the first set of horizontal frame elements 510 and the second set of horizontal frame elements 510. The subset of frame elements 510 that are transverse to the direction of propagation of the planar substrate 130 cause a portion of the microwave energy that exits the microwave dryer 120 to be reflected back into the microwave dryer 120. Meanwhile, mounting flange 530, which is hollow, defines a female receptacle for covering an end of a microwave dryer. For a frame utilized at an entrance of a dryer, the process direction may be reversed. Vent holes 540 are also illustrated, via which evaporated volatiles within choke assembly 500 may be disposed.

Figure 6:
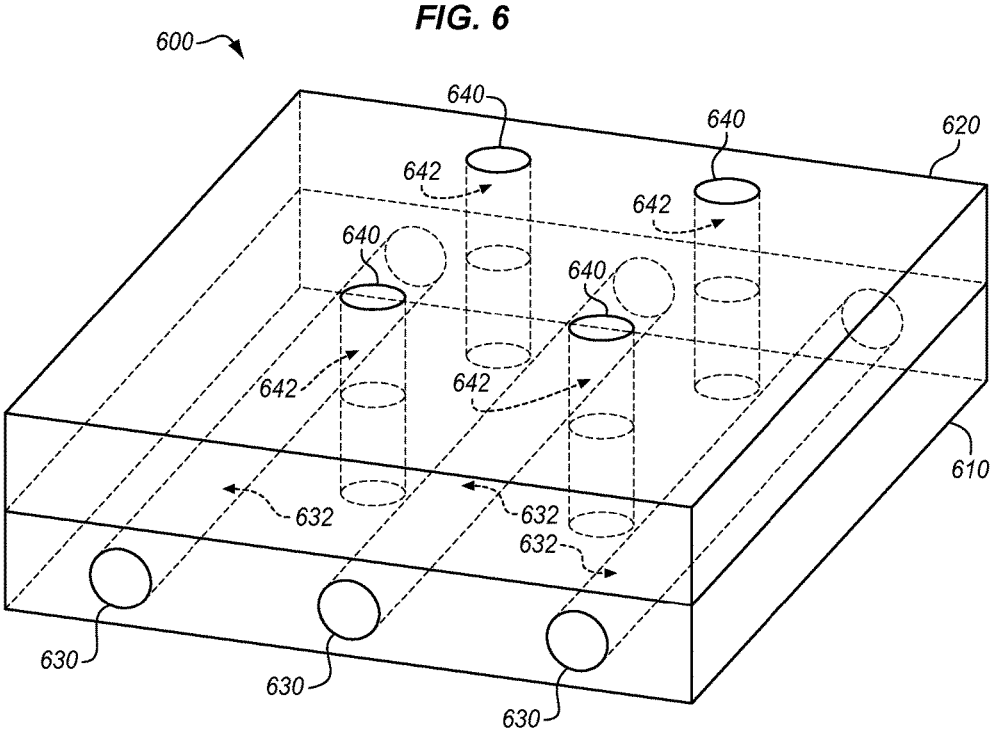
FIG. 6 illustrates a choke plate having bore holes for receiving cylinders of material, and vent holes for providing heated air, in an illustrative embodiment.
Figure 7:
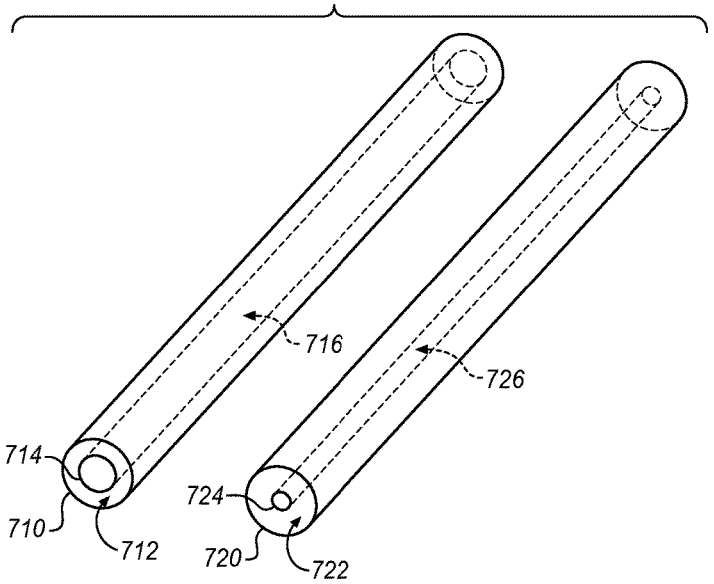
FIG. 7 illustrates cylinders for insertion into the bore holes of FIG. 6 in an illustrative embodiment.

In further embodiments, material 230 may be inserted via rods placed within a choke plate. FIGS. 6-7 illustrate one such embodiment. FIG. 6 illustrates choke plate 600 having bore holes 630 defining chambers 632 for receiving cylinders of material in an illustrative embodiment. The length of bore holes 630 may extend transversely across the path to further facilitate uniform drying. In this embodiment, choke plate 600 includes layer 610, which is transparent to microwave radiation (e.g., a layer of fused quartz), as well as layer 620, which is not transparent to microwave radiation (e.g., a layer of steel). This ensures that microwave radiation may travel freely to and/or from material 230, without exiting choke plate 600. Vent holes 640, defining chamber 642, are also illustrated. Vent holes 640 and chambers 642 collectively enable air to be forced downward through the vent holes 640 and chambers 642. Note that vent holes 640 and passageways 642 do not intersect passageways 632, and reside in between passageways 632. Air that passes downward through passageways 642 provides the convective heating component from the surrounding heated substrate. This forced air is heated by choke plate 600, and then directly impinges downward upon planar substrate 130, further drying planar substrate 130. If choke plate 600 is flipped vertically, then the air flow through the associated vent holes 640 and chambers 642 would impinge upon the planar substrate 130 in an upward direction. This downward/upward air flow also mitigates vertical fluttering of the planar substrate 130 as it propagates through a choke assembly. Choke plate 600 may be utilized as an upper choke plate at its current orientation, or may be flipped vertically to operate as a lower choke plate. While only one row of chambers 632 is illustrated in this embodiment, in further embodiments multiple rows of chambers 632 may be disposed within layer 610.

FIG. 7 illustrates cylinders for insertion into the bore holes of FIG. 6 in an illustrative embodiment. Cylinder 710 includes body 712, which defines hole 714 and hollow chamber 716, into which material 230 may be poured, packed, or otherwise distributed. Cylinder 720 includes body 722, which defines hole 724 and hollow chamber 726, into which material 230 may be poured, packed, or otherwise distributed. The diameters of holes in different cylinders may vary based on the amount of material 230 desired in each cylinder. These diameters may even vary between cylinders inserted into the same choke plate.

Examples

In the following examples, additional processes, systems, and methods are described in the context of a choke assembly for a microwave dryer.

In this example, microwave dryer 120 dries a planar substrate 130 comprising a continuous web of print media which has been marked by marking engine 114 of printer 110. A choke assembly 140 is disposed at the entrance and exit of microwave dryer 120. Choke assemblies 140 attenuate microwave radiation escaping from these openings in microwave dryer. In this example, choke assemblies 140 define a half-inch tall gap which is ten inches wide. Planar substrate 130 continues through choke assemblies 140. Choke assemblies 140 are made from multiple choke plates, and each choke plate includes a layer of graphitized carbon black along a surface facing planar substrate 130. Particles of the graphitized carbon black are encased by fused quartz. Microwave radiation transparently passes through the fused quartz and strikes the graphitized carbon black. The graphitized carbon black emits infrared blackbody radiation in response to absorbing microwave radiation from microwave dryer 120. The blackbody radiation heats the fused quartz, and portions of the blackbody radiation may strike planar substrate 130, heating planar substrate 130. The fused quartz increases in temperature via thermal conduction with the encased particles of graphitized carbon black. Airflow travels through vent holes placed in the choke plates, heating in response to passing through choke assembly 140 (in particular, the fused quartz), and drying planar substrate 130.

Figure 8:
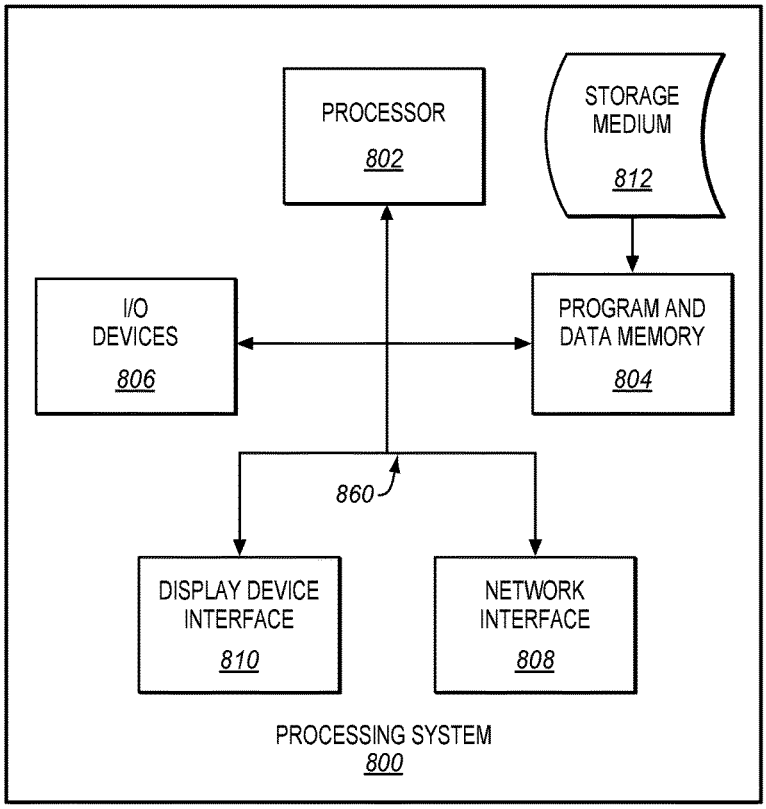
FIG. 8 illustrates a processing system operable to execute a computer readable medium embodying programmed instructions to perform desired functions in an illustrative embodiment.

Control elements for various components described herein can take the form of software, hardware, firmware, or various combinations thereof. In one particular embodiment, software is used to direct a processing system of print controller 112 to perform the various printing operations disclosed herein, or to control a speed of a drive roller. FIG. 8 illustrates a processing system 800 operable to execute a computer readable medium embodying programmed instructions to perform desired functions in an illustrative embodiment. Processing system 800 is operable to perform the above operations by executing programmed instructions tangibly embodied on computer readable storage medium 812. In this regard, embodiments of the invention can take the form of a computer program accessible via computer-readable medium 812 providing program code for use by a computer or any other instruction execution system. For the purposes of this description, computer readable storage medium 812 can be anything that can contain or store the program for use by the computer.

Computer readable storage medium 812 can be an electronic, magnetic, optical, electromagnetic, infrared, or semiconductor device. Examples of computer readable storage medium 812 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 800, being suitable for storing and/or executing the program code, includes at least one processor 802 coupled to program and data memory 804 through a system bus 850. Program and data memory 804 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 806 (including but not limited to keyboards, displays, pointing devices, etc.) can be coupled either directly or through intervening I/O controllers. Network adapter interfaces 808 may also be integrated with the system to enable processing system 800 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 810 may be integrated with the system to interface to one or more display devices, such as printing systems and screens for presentation of data generated by processor 802.

Although specific embodiments were described herein, the scope of the invention is not limited to those specific embodiments. The scope of the invention is defined by the following claims and any equivalents thereof.

What is claimed is:

1. An apparatus comprising:

a choke assembly comprising:

a first choke plate;

a second choke plate that is positioned a distance away from the first choke plate, resulting in a gap between the first choke plate and the second choke plate;

a first layer disposed at a surface of the first choke plate, the first layer comprising:

a material that attenuates microwave radiation via dielectric heating by converting the microwave radiation into heat; and a substance, disposed between the material of the first layer and the gap, that is transparent to the microwave radiation; and a second layer disposed at a surface of the second choke plate that faces the first layer, the second layer comprising:

the material that attenuates the microwave radiation via dielectric heating by converting the microwave radiation into heat; and the substance, disposed between the material of the second layer and the gap, that is transparent to the microwave radiation.

2. The apparatus of claim 1 wherein:
the material comprises graphitized carbon black having a particle size between 180 and 250 micrometers.
3. The apparatus of claim 1 wherein:
the first layer exhibits a decreasing concentration of the material as distance from the surface of the first choke plate increases; and
the second layer exhibits a decreasing concentration of the material as distance from the surface of the second choke plate increases.
4. The apparatus of claim 1 wherein:
the substance is also transparent to infrared radiation.
5. The apparatus of claim 1 further comprising:
a frame comprising a first set of frame elements that define a first compartment that holds the first choke plate, a second set frame elements that define a second compartment that holds the second choke plate, frame elements that unite the first set of frame elements to the second set of frame elements, and a mounting flange for attaching the choke assembly to an exit of a microwave dryer.
6. The apparatus of claim 1 wherein:
the first choke plate further comprises first vent holes that penetrate through the first layer of the material and enable first airflow through the first layer of the material; and
the second choke plate further comprises second vent holes that penetrate through the second layer of the material and enable second airflow through the second layer of the material.
7. The apparatus of claim 1 further comprising:
a continuous transport belt that continues through the gap.
8. The apparatus of claim 1 further comprising:
printed media that continues through the gap.
9. The apparatus of claim 1 further comprising:
a microwave dryer that dries the planar substrate, and is positioned upstream of the choke assembly, wherein the choke assembly attenuates microwave radiation from an exit of the microwave dryer.
10. The apparatus of claim 9 further comprising:
a continuous forms inkjet printer that is disposed upstream of the microwave dryer and that marks the planar substrate.
11. The apparatus of claim 9 further comprising:
a cut-sheet inkjet printer that is disposed upstream of the microwave dryer and that marks the planar substrate.
12. The apparatus of claim 9 further comprising:
an inkjet printer that is disposed upstream of the microwave dryer and that marks the planar substrate.
13. A system comprising:
a microwave dryer that applies microwave radiation to a planar substrate traveling through a waveguide of the microwave dryer in a process direction; and
a choke assembly downstream of the microwave dryer, the choke assembly comprising:
a first choke plate;
a second choke plate that is positioned a distance away from the first choke plate, resulting in a gap between the first choke plate and the second choke plate for receiving a planar substrate;
a first layer disposed at a surface of the upper choke plate, the first layer comprising:
a material that attenuates microwave radiation via dielectric heating by converting the microwave radiation into heat; and
a substance, disposed between the material of the first layer and the gap, that is transparent to the microwave radiation; and
a second layer disposed at a surface of the second choke plate that faces the first layer, the second layer comprising:
the material that attenuates the microwave radiation via dielectric heating by converting the microwave radiation into heat; and
the substance, disposed between the material of the second layer and the gap, that is transparent to the microwave radiation.
14. The system of claim 13 wherein:
the material comprises graphitized carbon black having a particle size between 180 and 250 micrometers.
15. The system of claim 13 wherein:
the substance is also transparent to infrared radiation.
16. A method comprising:
drying a planar substrate via microwave radiation while a planar substrate travels in a process direction through a waveguide of a microwave dryer;
transporting the planar substrate through a choke assembly disposed downstream of the microwave dryer;
receiving microwave radiation at the choke assembly from an opening of the microwave dryer via which the planar substrate exits the microwave dryer;
permitting the microwave radiation to transparently pass through a solid component of the choke assembly; and
performing dielectric heating by converting received microwave radiation into heat, wherein the dielectric heating is performed by a material disposed along an interior of the choke assembly.
17. The method of claim 16 further comprising:
permitting an amount of thermal radiation to transparently pass through the solid component of the choke assembly.
18. The method of claim 16 further comprising:
marking the planar substrate with a printer, prior to drying the planar substrate.
19. The method of claim 16 wherein:
drying the planar substrate comprises drying a continuous web of print media.
20. The method of claim 16 further comprising:
receiving airflow through holes in the choke assembly that convectively cool the choke assembly.

* * * * *